United States Patent [19]

Becker

[11] 4,230,024

[45] Oct. 28, 1980

[54] ADJUSTABLE STROKE CYLINDER

[75] Inventor: Michael L. Becker, Akron, Ohio

[73] Assignee: A-T-O Inc., Willoughby, Ohio

[21] Appl. No.: 923,633

[22] Filed: Jul. 11, 1978

[51] Int. Cl.[3] ..... F15B 15/22; F15B 15/24

[52] U.S. Cl. ..... 92/13.1; 92/13.6; 92/110; 91/396

[58] Field of Search ..... 92/13.1, 13.6, 110; 91/394, 396, 395

[56] References Cited

U.S. PATENT DOCUMENTS

| | | | |
|---|---|---|---|
| 2,478,790 | 8/1949 | Stephens | 92/13.1 |
| 2,596,471 | 5/1952 | Densmore | 92/13.1 |
| 2,604,076 | 7/1952 | Trevasbis | 92/110 |
| 2,614,536 | 10/1952 | Livers | 92/13.1 |
| 2,922,397 | 1/1960 | Haanes | 92/13.6 |

*Primary Examiner*—Paul E. Maslousky

*Attorney, Agent, or Firm*—Oldham, Oldham, Hudak & Weber

[57] ABSTRACT

An adjustable stroke piston and cylinder combination including a piston fixed to one end of a piston rod that extends from one end of the cylinder, and an auxiliary piston is in sealed engagement with the cylinder means and the piston rod and is slidable on the piston rod, the piston rod is tubular with pressure supply ports therein connecting its bore to a point intermediate the piston and auxiliary piston while a liquid supply means connects to the one end of the cylinder means to supply pressure liquid intermediate the closed end of the cylinder means and the auxiliary piston to move the same axially on the piston rod to control the effective length of the piston stroke in the cylinder means.

4 Claims, 3 Drawing Figures

ADJUSTABLE STROKE CYLINDER

BACKGROUND OF THE INVENTION

In various types of controlled mechanisms, it is desirable to have an accurate reciprocating action provided for a power cylinder and/or piston rod device for moving a controlled article positively and rapidly through a predetermined distance. Furthermore, it is usually necessary to provide a substantially standard cylinder unit where the effective stroke of the control piston can be adjusted to meet various required operating conditions.

One prior art construction in U.S. Pat. No. 2,922,397 has an operating piston with an auxiliary movable piston head positioned on the piston rod for varying the piston stroke by variation in the operative effective length of the piston means in the unit.

The provision of pressurized liquids or fluids for use in cylinder systems from supply reservoirs is disclosed in U.S. Pat. No. 3,494,027 and U.S. Pat. No. 4,015,538; while the provision of a movable cylinder and a fixed piston rod communicating with a fluid source through a bore in the anchor means is shown in U.S. Pat. Nos. 3,568,559 and 3,577,831.

In constructions of the types provided heretofore, some appreciable leakage problems were involved inasmuch as two axially spaced pistons moved with the piston rod and both required sealing action in the cylinder, and also the cylinder required a barrel finish and the friction or break away force of these two piston devices was quite high.

There is a need in the art for a good piston and cylinder combination having an adjustable length stroke and wherein the apparatus is efficient to operate and relatively easy to maintain.

OBJECTS OF THE INVENTION

The general object of the present invention is to provide a new and improved adjustable stroke piston and cylinder combination in which the length of stroke of the piston in the cylinder can be readily varied to set up repetitive operating conditions by an uncomplicated mechanical construction.

Another object of the invention is to provide an auxiliary piston in a cylinder device wherein the auxiliary piston can be moved axially in the cylinder by an externally supplied pressure liquid to control the operating length of the cylinder device and, hence, the piston stroke.

Other objects of the invention are to provide a reduced break away friction in an adjustable stroke piston and cylinder combination, to provide an air cushion action at both ends of movement of an adjustable length reciprocating piston, to provide improved seal conditions in an adjustable stroke piston and cylinder combination, and to provide apparatus of the type described that will have a long service life with a minimum of maintenance.

In the accompanying drawings.

When referring to corresponding members shown in the drawings and referred to in the specification, corresponding numerals are used to facilitate comparison therebetween.

SUBJECT MATTER OF INVENTION

The invention, as one embodiment thereof, relates to a piston and cylinder combination wherein the piston has an adjustable length stroke; the apparatus comprising a cylinder means having closed ends, a piston with a piston rod secured thereto slidably positioned in the cylinder means, which piston rod is tubular and extends from one end of the cylinder means, and an auxiliary piston is in sealed engagement with the cylinder means and the piston rod, the piston rod having ports therein connecting its bore to a point intermediate the piston and the auxiliary piston, and a liquid supply means connects to the one end of the cylinder means for supply of liquid under pressure thereto for flow into contact with a face of the auxiliary piston so that the position of the auxiliary piston on the piston rod can be varied in relation to the closed end of the cylinder means and the effective operative length of the cylinder means is hence controllable from one end thereof.

DETAILED DESCRIPTION OF INVENTION

Figure 1:
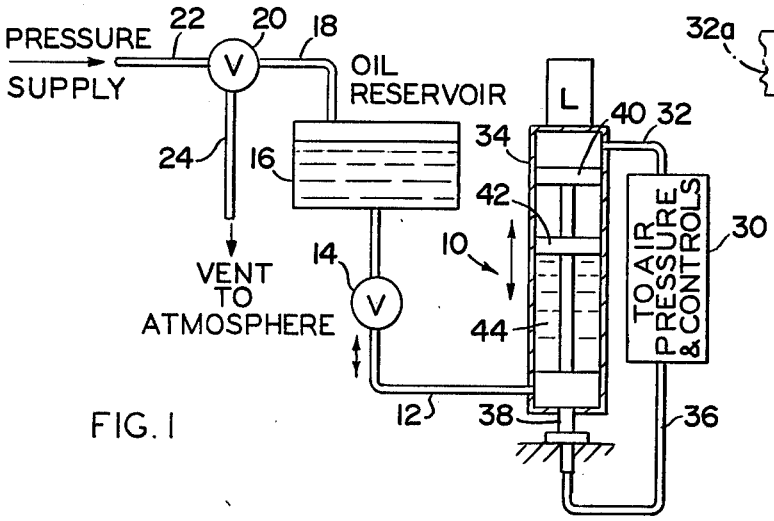
FIG. 1 is a diagrammatic view of apparatus of the invention including means in association therewith for supply of liquid under pressure to the adjustable stroke cylinder unit.

FIG. 1 diagrammatically shows an adjustable stroke piston and cylinder combination indicated as a whole by the numeral 10 and this combination has a liquid pressure supply line 12 connecting thereto, which line normally has a control valve 14 therein and with the line 12 extending to a reservoir 16 in which oil or other liquid is received and normally retained under pressure. A vent tube 18 extends from the reservoir 16 through a control valve 20 to an air pressure supply line 22 or to a vent tube or line 24 whereby any desired pressure can be established in the reservoir 16 and such pressure then can be transmitted when desired to the combination 10 as hereinafter described in more detail.

It will also be noted that FIG. 1 diagramatically indicates that any conventional type of air pressure supply means and/or controls 30 connect to a tube or line 32 that connects to one end of a cylinder 34 while the opposite supply path operated by the control 30 connects to a tube or line 36 that suitably operably connects to a piston rod 38 that extends into the cylinder 34 to connect to a piston 40 operably positioned therein. An auxiliary piston 42 is indicated in the cylinder 34 and it is separated from one end of the cylinder by a fixed volume of liquid indicated at 44. The effective length of stroke of the piston rod 38 and piston 40 thereon in the cylinder 34 is hence between the fixed position of the auxiliary piston 42 and the end of the cylinder to which the control line 32 connects, but which distance can be varied as desired as hereinafter described in more detail.

Figure 3:
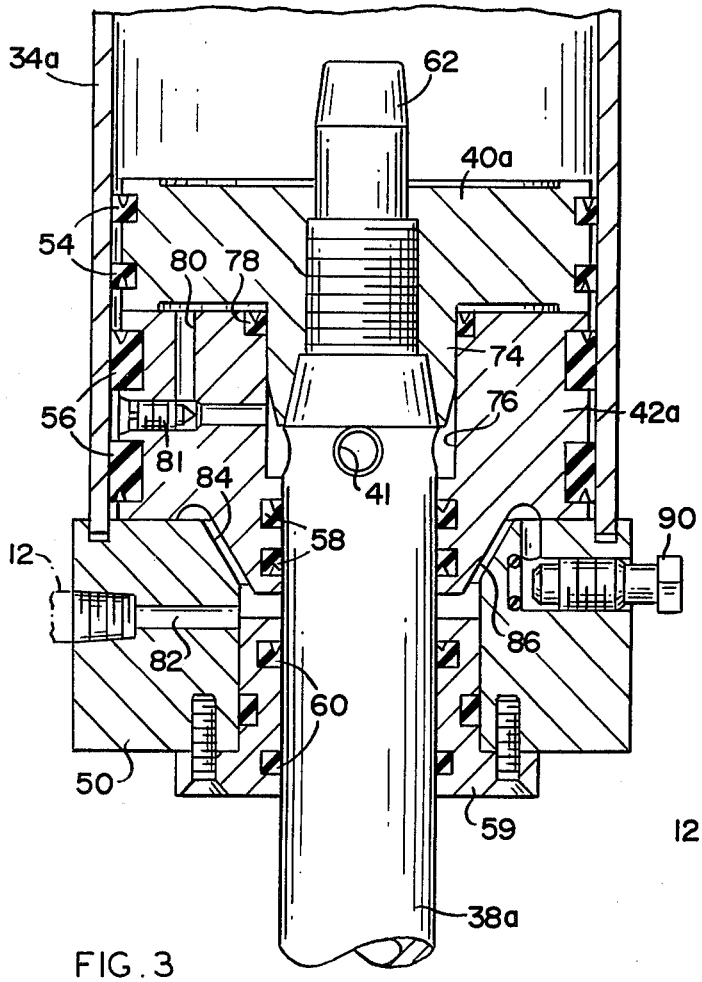
Figure 2:
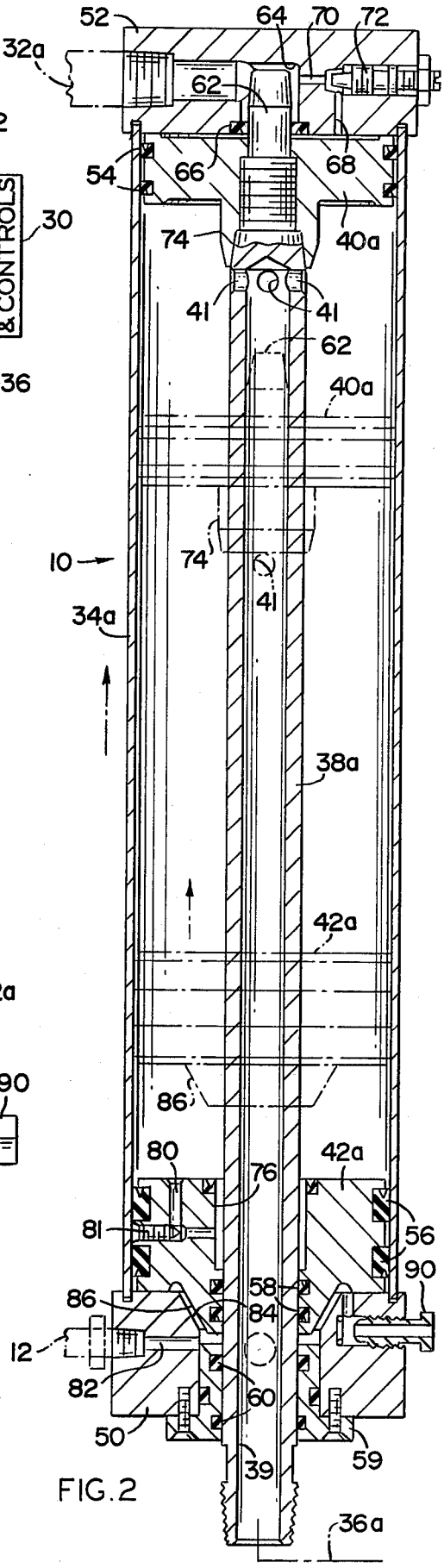
FIG. 2 is a vertical section through the adjustable stroke piston and cylinder combination embodying the principles of the invention; and, FIG. 3 is an enlarged vertical section of the closed end of the cylinder of FIG. 2.

While the parts in the apparatus of the invention are as shown diagrammatically in FIG. 1, suffixes will be added to the numerals identifying these corresponding parts in FIGS. 2 and 3 of the drawings since the parts are shown in more detail and are more engineeringly complete in these figures.

Hence, in the apparatus shown in FIGS. 2 nd 3, a cylinder 34*a*, a piston rod 38*a*, A piston 40*a*, an auxiliary piston 42*a* are shown, and such cylinder unit 34*a* connects to a control line 32*a*. The opposite control line 36*a* operably connects to a bore 39 for the piston rod for supply of pressure fluid through the bore for passage to outlet ports 41 provided at the axially inner end of the piston rod immediately adjacent the face of the piston 40*a*. The lines or tubes 12, 32, 36, 32*a*, 36*a*, or the like, are flexible when required.

In the use of the apparatus of the invention, the end of the piston rod 38*a* is usually suitably anchored in position, as indicated in FIG. 1, whereby the entire cylinder 34*a* will be reciprocated for the control action as desired. A load indicated at L can be provided on one end of the cylinder for controlled movement by the apparatus of the invention. Or, the cylinder can be secured in position and the load can be carried by a movable piston rod.

The cylinder 34*a* is provided with one closed end 50 through which the piston rod 38*a* extends and the opposite end of the cylinder 34*a* has an end plate 52 suitably fixedly secured thereto.

The piston 40*a* is sealed in the cylinder 34*a* by conventional seals 54, such as O-rings, while the auxiliary piston 42*a* is sealed in the cylinder by static seals 56. It also is sealed in relation to the piston rod 38*a* by seals 58. Conventional liquid seals 60 are provided in operative engagement with a packing gland 59 or similar device engaging in the closed end 50 for sealing the piston rod 38*a* against leakage in the unit of the invention.

It also is a feature of the invention that adjustable air cushion stops are provided at each end of reciprocation for the piston 40*a*, and thus the piston and piston rod assembly has a probe or finger 62 protruding axially therefrom into the cylinder 34 and it extends into a chamber 64 formed in the closed end 52. The probe is sealed in the chamber by a sealing ring 66 so that air entrapped between the closed end of the cylinder and the piston 40*a* can only gradually bleed therefrom through a bore 68 provided in the end of 52. This bore 68 connects to an internal bore 70 and the chamber 64 for flow to the control line or tube 32*a*. Additionally, an adjustable valve 72 is adjustably engaged with the closed end 52 for controlling the flow rate of the entrapped air from the bore 68 out through the connecting means 70 for exhaust from the cylinder.

Likewise, at the opposite end of the cylinder, a similar air cushion unit is provided and in this instance, a tubular extension 74 on the piston 40*a* extends towards the closed end 50 of the cylinder means. Such tubular extension is adapted to be received in a counterbore 76 provided in the auxiliary piston 42*a* and be sealed therein as by a seal device 78 at the axially inner face of such member. Hence, air entrapped between the adjacent faces of the piston 40*a* and auxiliary piston 42*a* will slowly bleed through a small discharge bore 80 formed in the axially inner face of the auxiliary piston and connecting to the counterbore 76 for flow to the outlet bores 41 formed in the piston rod for flow, again, back to the control system used. The entrapped air release flow rate is controlled by a valve 81 operably carried by the auxiliary piston and engaging the bore 80.

From the foregoing diagrammatic disclosure of the invention, it is seen that the position of the auxiliary piston 42*a* can be controlled in relation to the piston rod 38*a* when the valve 14 is opened to permit flow of pressure liquid through the line 12 into the cylinder combination of the invention. As to further details, such liquid pressure supply line 12 connects to the closed end, or end plate 50, and liquid flows through a bore 82 in such end plate to the radially inner portion of the cylinder adjacent the piston rod 38*a* and to an opening 84 provided between the axially outer face 86 of the auxiliary piston 42 and the adjacent portion of the closed end plate 50 for flow of such pressure liquid to such area. This pressure liquid will move the auxiliary piston axially on the piston rod towards the fixed piston 40*a* as shown in FIG. 2.

The pressure on the liquid in the reservoir 16 in the pressure system, as controlled by the valve 20 or other means, is sufficient so that opening the valve 14 provides liquid flow to cause axial movement of the auxiliary piston 42*a* towards the piston 40*a*. Such movement is suitably controlled or adjusted by such valves 14 and 20 and auxiliary piston adjustment also can be aided by the setting of the pressure control means 30 to obtain the effective operating length desired for the cylinder 34*a*. The valve 14 then is closed to maintain the auxiliary piston 42*a* in the desired position. The auxiliary piston 42*a* can be moved towards the closed end plate 50 by pressure release on line 12 and pressure application by the controls 30.

Air entrapped in the system between the auxiliary piston and the closed end of the cylinder can be bled therefrom as by a conventional air bleed device 90 engaging the closed end 50 of the cylinder 34*a*. In the apparatus as shown, it will be seen that the pressure supply line 32 is the piston and cylinder combination extension pressure supply line, while pressure supplied through the line 36*a* is the piston and cylinder combination retraction pressure supply line to provide rapid, controlled accurate reciprocating action desired in the apparatus of the invention. While the seals of the invention are conventional, the present apparatus design is such that no barrel finish is required on the interior of the cylinder 34*a* and significantly lower break away friction exists in this apparatus than in prior structures. Only the piston 40*a* moves in the cylinder, and the piston rod 38*a* moves only in relation to the auxiliary piston 42*a* and the closed end 50 of the cylinder whereby the apparatus is relatively readily sealed and operates efficiently.

From the foregoing, it is believed that a novel and improved adjustable stroke piston and cylinder combination has been provided and that the objects of the invention have been achieved.

While one complete embodiment of the invention has been disclosed herein, it will be appreciated that modification of this particular embodiment of the invention may be resorted to without departing from the scope of the invention.

What is claimed is:

1. An adjustable stroke piston and cylinder combination comprising:

a cylinder means having closed ends, a piston with a piston rod secured thereto slidably positioned in said cylinder means, said piston rod being tubular, having a bore, and extending from one end of said cylinder means, an auxiliary piston in sealed engagement with said cylinder means and said piston rod, said piston rod having ports therein connecting its bore to a point intermediate said piston and said auxiliary piston, liquid supply means connecting to said one end of said cylinder means for supply of liquid under pressure thereto whereby the effective length of said cylinder means can be controlled from one end thereof by moving said auxiliary piston away from said one end of said cylinder means and retaining it in a given position when said piston and piston rod reciprocate in relation to said cylinder means, an adjustable air cushion means being provided in said cylinder; and said auxiliary piston having a bleeder bore therein operatively connecting its axially inner face to said piston rod bore, said air cushion means including a valve controlling fluid flow through said bleeder bore, which valve is accessible from the periphery of said auxiliary piston.

2. An adjustable stroke piston and cylinder combination comprising:

a cylinder means having closed ends, a piston slidably positioned in said cylinder means, a piston rod secured to said piston and extending from one end of said cylinder means, an auxiliary piston slidably positioned on said piston rod in said cylinder means and being in sealed engagement with said cylinder means and piston rod, said piston rod having a fluid supply bore and ports therein connecting a point externally of said cylinder means to a point intermediate said piston and auxiliary piston for supply of operating pressure fluid to said piston, liquid pressure supply means connecting to said one end of said cylinder means for flow of pressure liquid to the axially outer face of said auxiliary piston so that the effective length of said cylinder means can be controlled from one end thereof by change of the position of said auxiliary piston on said piston rod; pressure supply means connected to said piston rod bore and to the other end of said cylinder means for piston reciprocation while said auxiliary piston is stationarily positioned; and, an adjustable air cushion means formed in said cylinder for operation when said piston is moved to approach said auxiliary piston, said auxiliary piston having a bleeder bore therein operatively connecting its axially inner face to said piston rod ports and bore, and said air cushion means includes a valve controlling fluid flow through said bleeder bore, which valve is accessible from the periphery of said auxiliary piston.

3. An adjustable stroke piston and cylinder combination as in claim 2 where liquid supplied to said one end of said cylinder means flows to an area between the axially outer face of said auxiliary piston and said one end of said cylinder means to endeavor to cause movement of said auxiliary piston on said piston rod, and means are provided to confine a given volume of liquid in said cylinder means to retain said auxiliary piston in a given position.

4. An adjustable stroke piston, and cylinder combination comprising:

a cylinder means having closed ends, a piston slidably positioned in said cylinder means, a piston rod secured to said piston and extending from one end of said cylinder means, an auxiliary piston slidably positioned on said piston rod in said cylinder means and being in sealed engagement with said cylinder means and piston rod, said piston rod having a fluid supply bore and ports therein connecting a point externally of said cylinder means to a point intermediate said piston and auxiliary piston for supply of operating pressure fluid to said piston, liquid pressure supply means connecting to said one end of said cylinder means for flow of pressure liquid to the axially outer face of said auxiliary piston so that the effective length of said cylinder means can be controlled from one end thereof by change of the position of said auxiliary piston on said piston rod; pressure supply means connected to said piston rod bore and to the other end of said cylinder means for piston reciprocation while said auxiliary piston is stationarily positioned; and, an adjustable air cushion means formed in said cylinder for operation when said piston is moved to approach said auxiliary piston, said air cushion means including a tubular extension on said piston received in a counterbore formed in the axially inner face of said auxiliary piston, said auxiliary piston having a bleeder bore therein operatively connecting its axially inner face to said counterbore and said piston rod ports.

* * * * *